US008020272B2

(12) United States Patent
Ghiran et al.

(10) Patent No.: US 8,020,272 B2
(45) Date of Patent: Sep. 20, 2011

(54) METHOD FOR JOINING TUBES

(75) Inventors: Mike M. Ghiran, Lake Orion, MI (US); Spyros P. Mellas, Waterford, MI (US); David R. Jensen, Swartz Creek, MI (US); Paul D. Larsen, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1187 days.

(21) Appl. No.: 11/737,790

(22) Filed: Apr. 20, 2007

(65) Prior Publication Data

US 2008/0256778 A1 Oct. 23, 2008

(51) Int. Cl.
*B23P 17/00* (2006.01)

(52) U.S. Cl. ..... 29/421.1; 29/505; 29/507; 29/516; 29/897.2; 29/447

(58) Field of Classification Search ..... 29/421.1, 29/505, 507, 516, 447, 897.2
See application file for complete search history.

(56) References Cited

U.S. PATENT DOCUMENTS

| | | | | | |
|---|---|---|---|---|---|
| 2,504,625 | A | * | 4/1950 | Barnhart et al. | 285/289.3 |
| 3,210,102 | A | * | 10/1965 | Joslin | 285/374 |
| 4,132,437 | A | | 1/1979 | Green | |
| 4,257,155 | A | * | 3/1981 | Hunter | 29/511 |
| 4,330,924 | A | * | 5/1982 | Kushner et al. | 29/458 |
| 4,396,213 | A | * | 8/1983 | Hawkins | 285/289.3 |
| 4,850,621 | A | * | 7/1989 | Umehara | 285/322 |
| 5,720,092 | A | | 2/1998 | Ni et al. | |
| 5,775,740 | A | * | 7/1998 | Fukaya et al. | 285/256 |
| 5,918,914 | A | * | 7/1999 | Morris | 285/351 |
| 5,927,763 | A | * | 7/1999 | Mehr | 285/305 |
| 6,067,831 | A | * | 5/2000 | Amborn et al. | 72/58 |
| 6,244,088 | B1 | * | 6/2001 | Compton | 72/105 |
| 6,460,250 | B1 | * | 10/2002 | Amborn et al. | 29/897.2 |
| 6,474,534 | B2 | * | 11/2002 | Gabbianelli et al. | 228/131 |
| 6,654,995 | B1 | | 12/2003 | Wang et al. | |
| 6,701,598 | B2 | | 3/2004 | Chen | |
| 6,742,258 | B2 | | 6/2004 | Tarbutton et al. | |
| 6,842,956 | B1 | * | 1/2005 | Amborn et al. | 29/421.1 |
| 6,848,725 | B2 | * | 2/2005 | Logan et al. | 285/382 |
| 6,922,882 | B2 | * | 8/2005 | Shah et al. | 29/421.1 |
| 7,175,204 | B2 | * | 2/2007 | Tarbutton et al. | 280/785 |
| 7,269,986 | B2 | * | 9/2007 | Pfaffmann et al. | 72/60 |
| 7,399,942 | B2 | * | 7/2008 | Wang et al. | 219/93 |
| 7,452,004 | B2 | * | 11/2008 | Hayakawa | 285/55 |
| 7,941,907 | B2 | * | 5/2011 | Yang et al. | 29/419.2 |
| 2002/0007547 | A1 | * | 1/2002 | Unewisse et al. | 29/516 |
| 2004/0065394 | A1 | * | 4/2004 | Ryu et al. | 148/695 |
| 2009/0229102 | A1 | * | 9/2009 | Kobayashi et al. | 29/421.1 |

FOREIGN PATENT DOCUMENTS

| | | | | |
|---|---|---|---|---|
| CN | 871 05521 | A | | 3/1988 |
| DE | 3720620 | A1 | | 7/1988 |
| FR | 1.485.671 | | | 6/1967 |
| JP | 11201343 | A | | 7/1999 |
| JP | 2003254474 | A | | 9/2003 |
| TW | 200824812 | A | * | 6/2008 |

* cited by examiner

*Primary Examiner* — Essama Omgba

(57) ABSTRACT

A method is provided for joining tubes. An outer tube and an inner tube are provided. An end of the inner tube is inserted into an end of the outer tube to form an overlapped region of tube wall and form a pressure tight joint between the tubes. The overlapped region of the tubes is heated. The tubes are placed in pair of dies having a die cavity adjacent to the outer tube. Pressure is introduced into the tubes to expand the overlapped region of the tubes outwardly into the die cavity and thereby form an interlocking joint between the overlapped region of the outer tube and the inner tube.

5 Claims, 8 Drawing Sheets

METHOD FOR JOINING TUBES

FIELD OF THE INVENTION

The present invention relates to a method for joining tubes.

BACKGROUND OF THE INVENTION

It is known in motor vehicle manufacturing to provide a vehicle body or other structure by joining tubes together. The tubes can be butted together and joined by welding. Tubes can also be overlapped together by inserting a smaller tube into a larger end and then welding or bolting or adhesively bonding the overlapped region.

It would be desirable to provide a new and improved technique for joining together a plurality of tubes to form a vehicle structure.

SUMMARY OF THE INVENTION

A method is provided for joining tubes. An outer tube and an inner tube are provided. An end of the inner tube is inserted into an end of the outer tube to form an overlapped region of tube walls and form a pressure tight joint between the tubes. The overlapped region of the tubes is heated. The tubes are placed in a die having a die cavity adjacent to the outer tube and the ends of the tubes are sealed. Pressurized hot gas or steam is introduced into the tubes to expand the overlapped region of the tubes outwardly into the die cavity which thereby forms an interlocking joint between the overlapped region of the outer tube and the inner tube.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is exemplary in nature and is not intended to limit the invention, its application, or uses.

Figure 1:
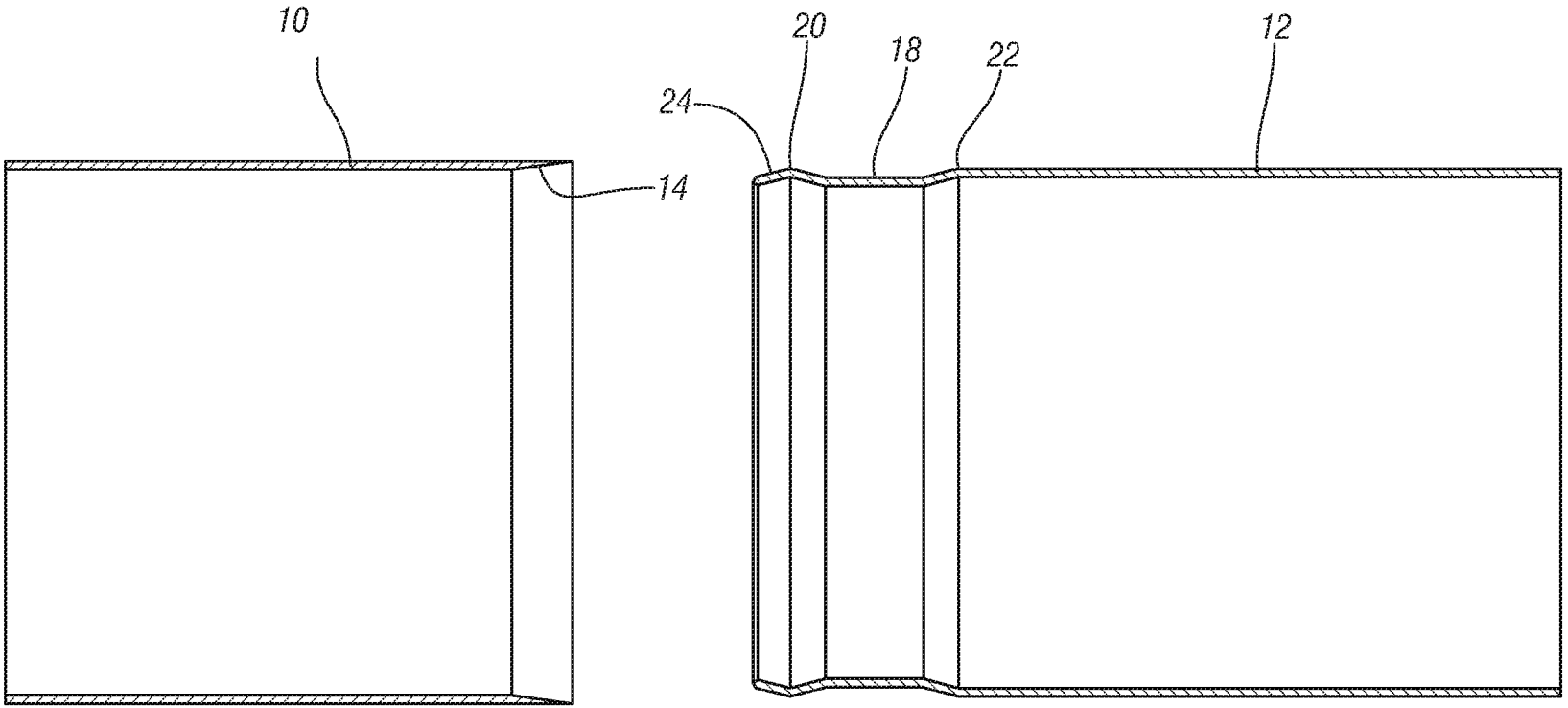
FIG. 1 is a section view showing two lengths of tube having formed ends.

Referring to FIG. 1, a metal tube 10 and a metal tube 12 are shown. Tubes 10 and 12 are sized so that the end portion of tube 12 will fit into the end portion of the tube 10 and the ends of the tubes are provided with inter-fitting structures. In particular, an end of tube 10 is formed to provide an internal chamfer 14, and an end of the tube 12 is formed to provide an indented region 18 that defines a ridge 20 and a ridge 22. A chamfer 24 is provided on the end of the tube 12.

Figure 2:
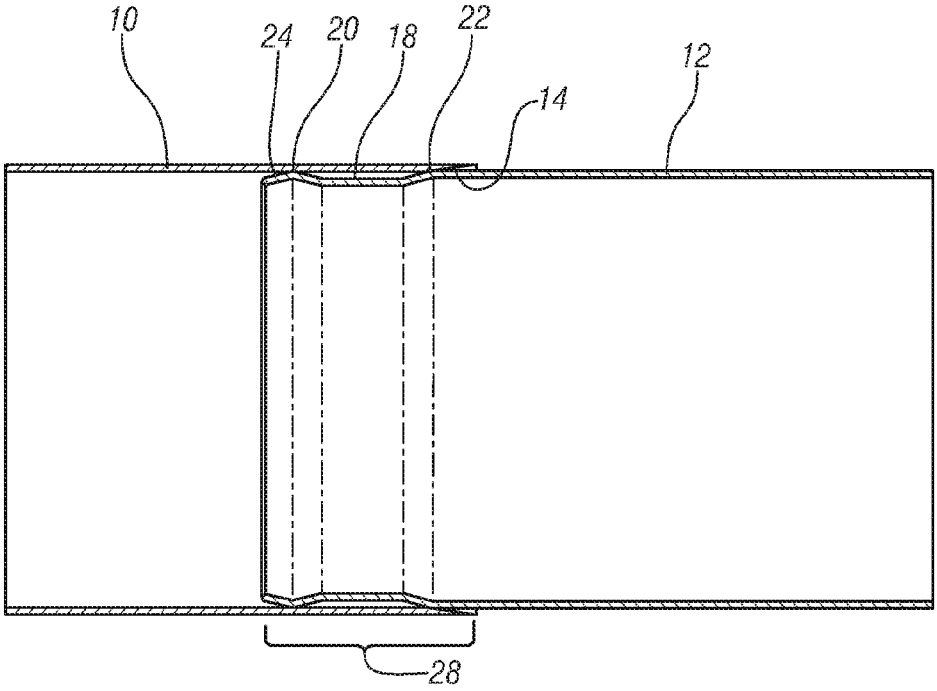
FIG. 2 is a section view showing that the tubes of FIG. 1 have been overlapped together.

FIG. 2 shows the formed end of the tube 12 inserted into the formed end of tube 10 to create a region of overlap 28 between the tubes 10 and 12. This insertion is aided by the chamfer 14 of outer tube 10 engaging with the chamfer 24 of the inner tube 12. As seen in FIG. 2, this insertion of tube 12 results in a tight fit between the inside of the outer tube 10 and the outside of the inner tube 12 at the ridges 20 and 22 so as to form a pressure tight joint between the tubes 10 and 12. The overlap and tight fit of the inter-fitting structures cooperate to temporarily join the tubes together.

Figure 3:
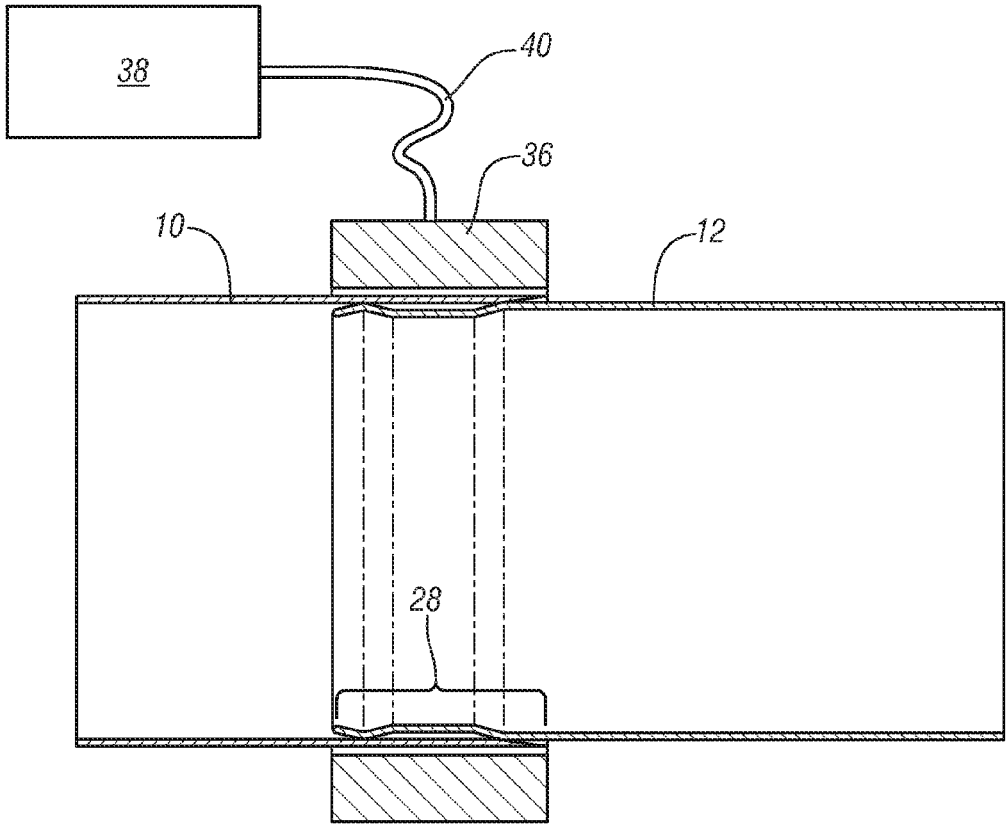
FIG. 3 is a section view showing an induction coil for heating the overlapped region of the tubes.

In FIG. 3, an induction coil 36 is positioned about the overlapped region 28. The induction coil 36 is conventionally connected to current source 38 by a cable 40. The induction coil 36 is energized and rapidly heats the overlapped region 28 of the outer tube 10 and inner tube 12.

Figure 4:
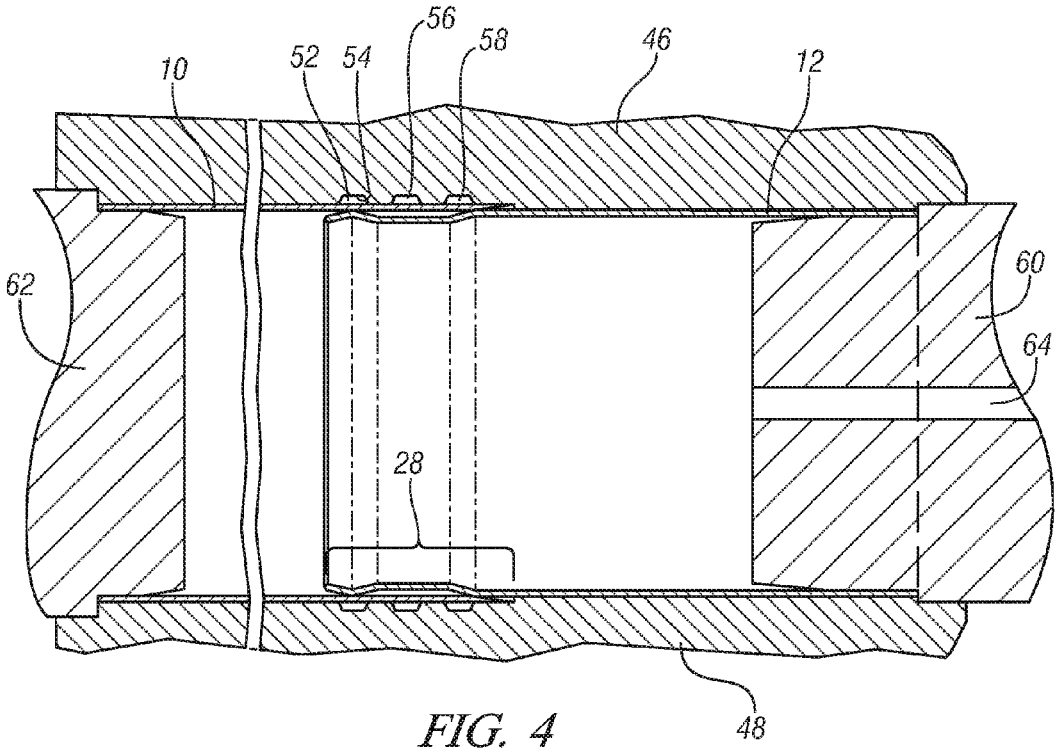
FIG. 4 is a section view showing the tubes placed into a die having a die cavity adjacent the overlapped region of the tubes and a seal sealing the end of the tubes.

After the overlapped region 28 is heated to soften the metal, the tubes 10 and 12 are captured between dies 46 and 48 as shown in FIG. 4. The dies 46 and 48 are heated so that the heated tubes 10 and 12 remain at an elevated temperature. The dies 46 and 48 have a die cavity 52 including ring-shaped cavity portions 54, 56 and 58 that encircle the overlapped region 28 of the tubes 10 and 12. A seal unit 60 is engaged in the end of the inner tube 12 and has an inlet 64. Another seal unit 62 is engaged in the end of the outer tube 10. The seal units 60 and 62 may be welded or otherwise held in place, and may have elastomeric seals therein. The seal units 60 and 62 seal the ends of the outer tube 10 and the inner tube 12 against pressure loss.

Figure 5:
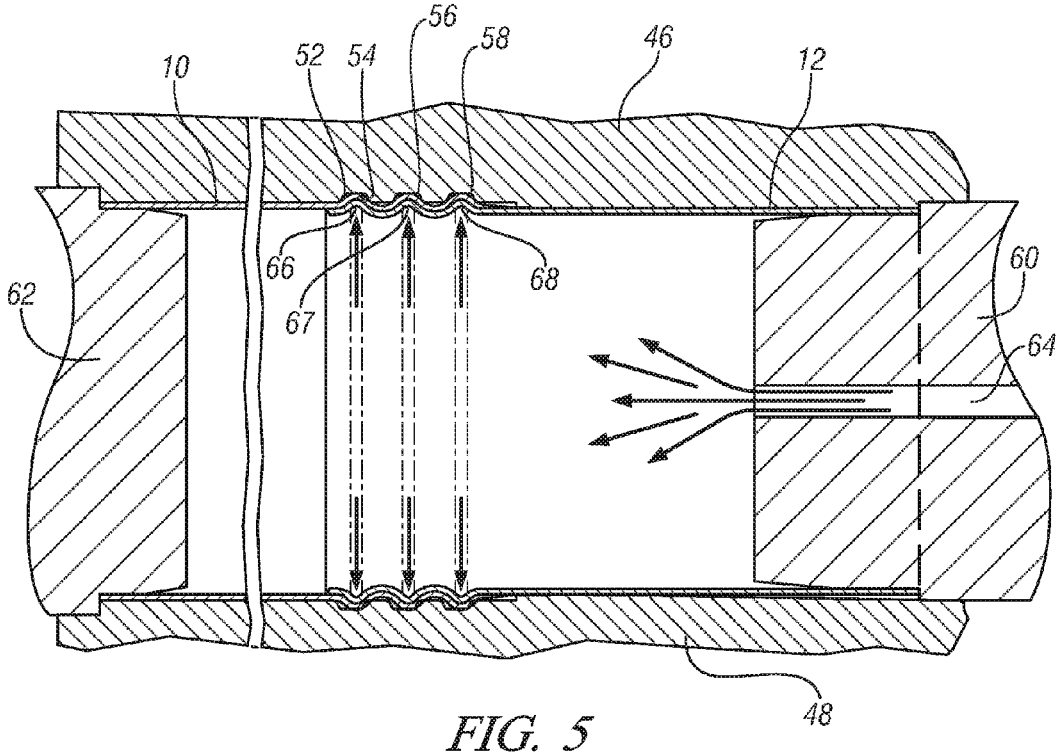
FIG. 5 is a section view showing pressurized gas or steam expanding the tubes outwardly into the die cavity.

Referring to FIG. 5, pressurized hot gas or steam is introduced through the inlet 64 provided in the seal unit 60 and expands the heated overlapped portion 28 of the tubes 10 and 12 radially outwardly into the cavity portions 54, 56, and 58 of the die cavity 52, thereby forming annular corrugations 66, 67 and 68 so that the tubes 10 and 12 are thereby permanently joined together by interlocking corrugated engagement of the walls thereof. The hot gas or steam pressure required to expand the heated overlapped portion 28 will be dependent upon many process variables, such as the diameter and wall thickness and formability of the tube 10 and 12, the depth of the cavity portions 54, 56 and 58, and the temperature of the tubes 10 and 12. The tight fit between the outer tube 10 and the inner tube 12 in conjunction with the clamping force provided on the outer tube 10 by the dies 46 and 48 provides a pressure tight connection between the tubes so that the pressurized hot gas or steam does not leak through the interface between the tubes 10 and 12.

Thereafter, the dies 46 and 48 are opened and the permanently joined together tubes 10 and 12 are removed and cooled to ambient temperature.

Figure 6:
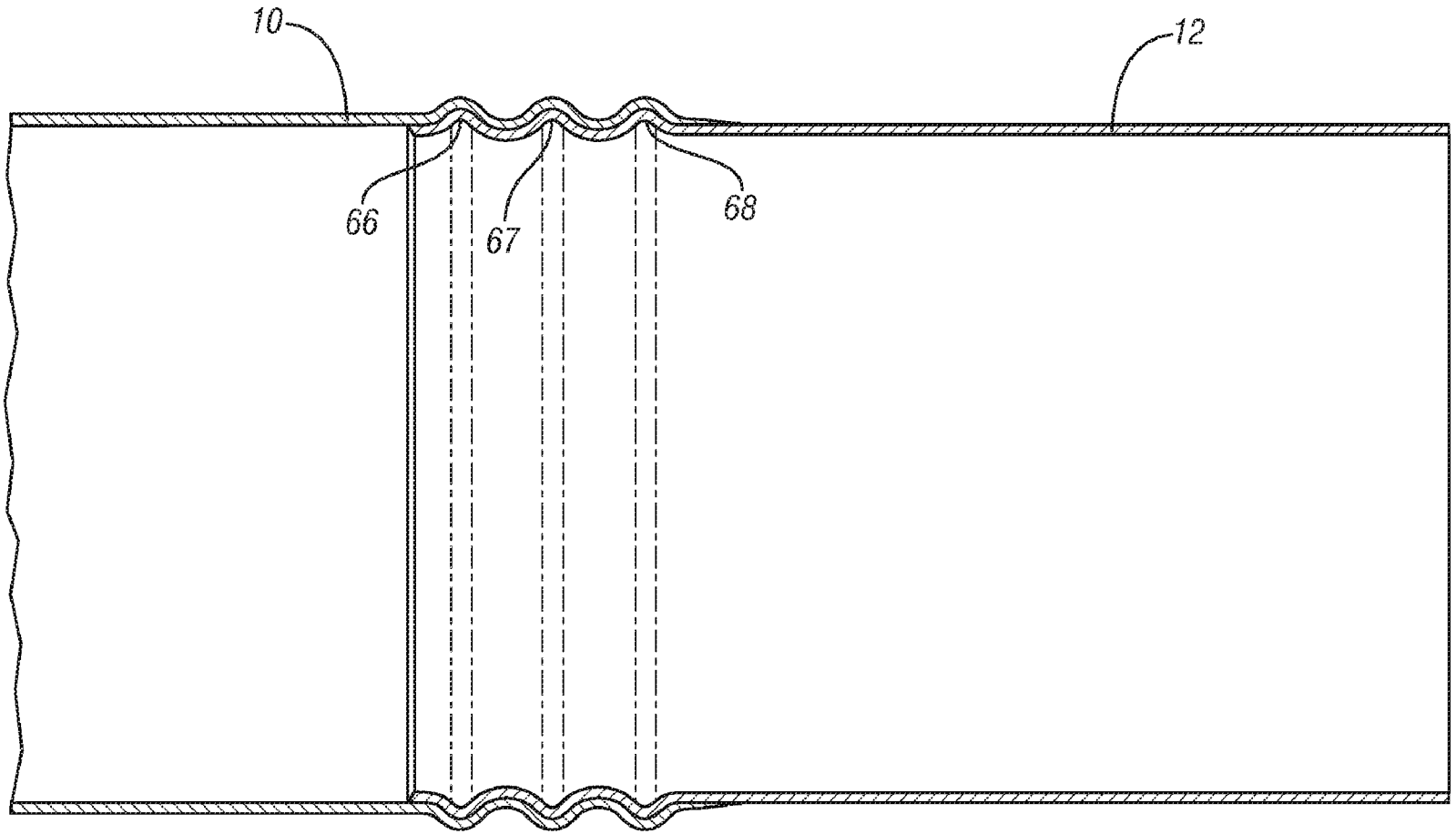
FIG. 6 is a section view showing the tubes joined together.

FIG. 6 shows the tubes permanently joined together. Depending upon the product application, the joined together tubes, shown in FIG. 6, can be further processed by bending or hydroforming or by other known processing techniques.

Figure 7:
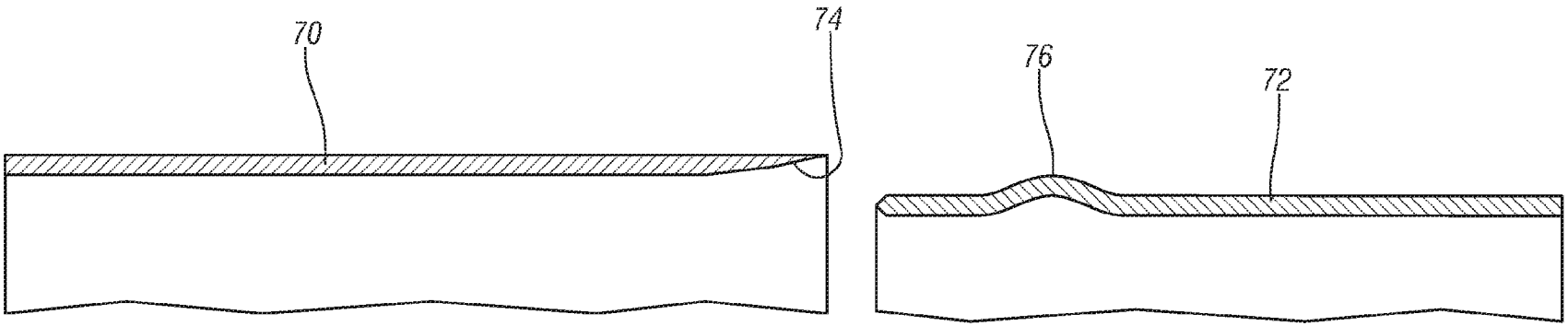
FIG. 7 is a section view of another embodiment in which two lengths of tube have formed ends.

FIGS. 7-10 show another embodiment of the invention. FIG. 7 shows a tube 70 and a tube 72 that are sized so that the end portion of inner tube 72 will fit into the end portion of the outer tube 70. The end of outer tube 70 is formed to provide an internal chamfer 74. The end of the tube 72 is formed to provide an upstanding ridge 76 that encircles the inner tube 72.

Figure 8:
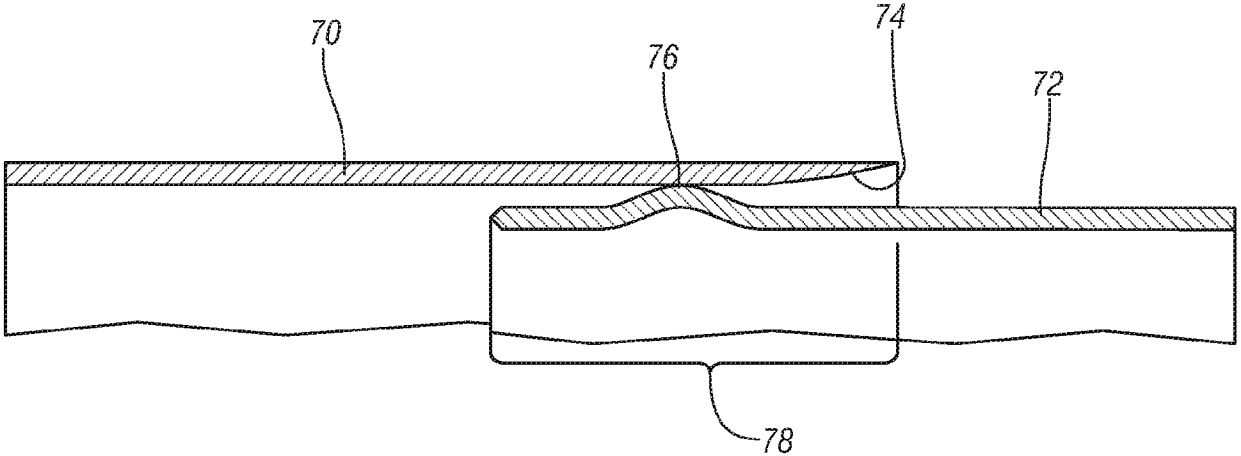
FIG. 8 is a section view showing the tubes of FIG. 7 overlapped together.

FIG. 8 shows the inner tube 72 inserted into the end of outer tube 70 to create a region of overlap 78 between the tubes 70 and 72. This insertion is aided by the chamfer 74 of outer tube 70 engaging with the ridge 76 of the inner tube 72. As seen in FIG. 8, this insertion of tube 72 results in a pressure tight fit between the inside of the outer tube 70 and the outside of the inner tube 72 at the ridge 76 and temporarily attaches the tubes together.

Figure 9:
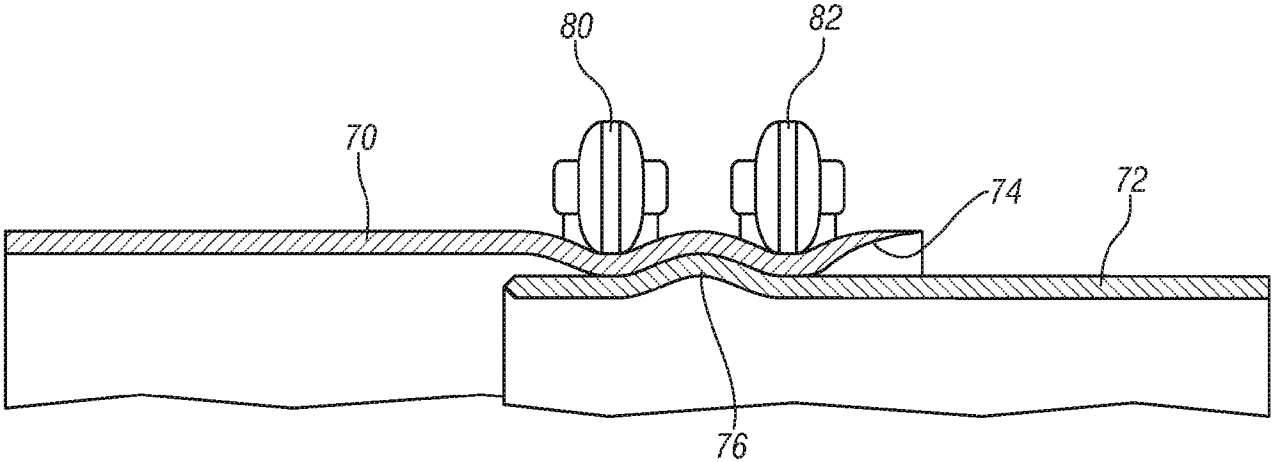
FIG. 9 is a section view showing a roller mechanism for sealing the two tubes together.
Figure 10:
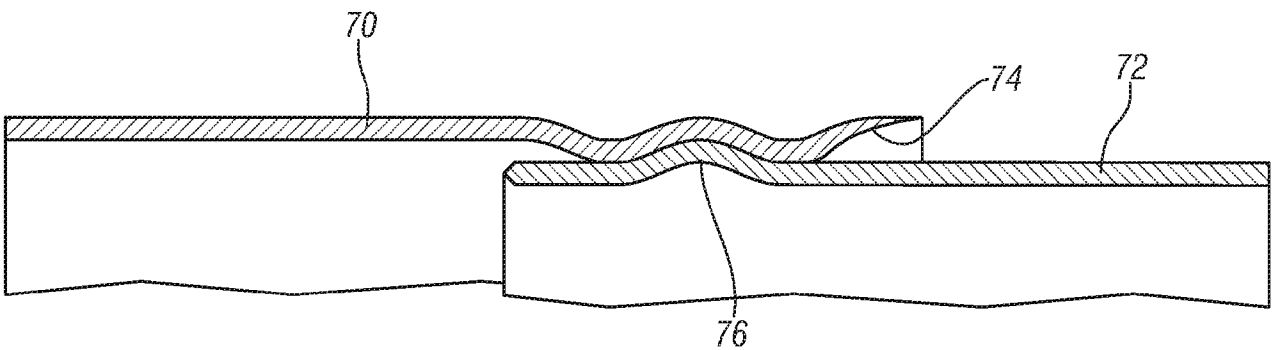
FIG. 10 is a section view showing the two tubes sealed together and ready to be induction heated and placed into a die for expansion by pressurized steam or heated gas.

In FIG. 9, a pair of rollers 80 and 82 is employed to form the outer tube 70 over the ridge 76 of the inner tube 72 in order to perfect the pressure sealing engagement between the outer tube 70 and the inner tube 72. Thus, as seen in FIG. 10, the tubes 70 and 72 are connected together and ready to be heated by the induction coil 36, as shown hereinbefore in relation to FIG. 3, and then pressure formed in a die cavity 52 as shown and discussed hereinbefore in relation to FIG. 5.

Figure 11:
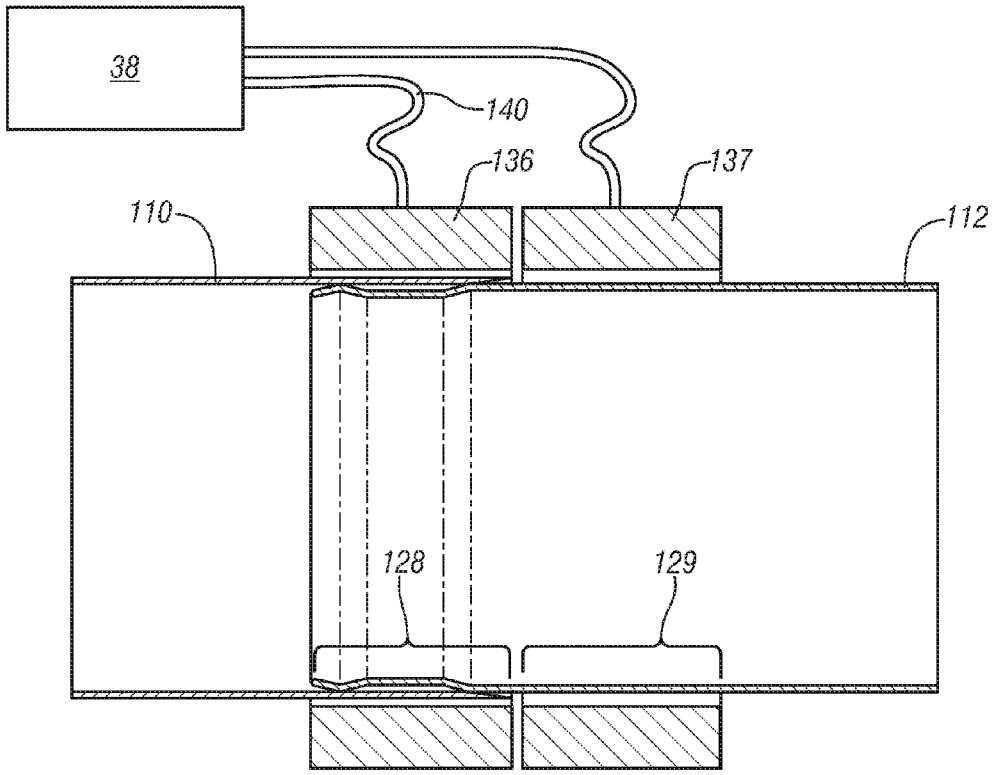
FIG. 11 is a section view showing another embodiment of the invention in which an additional induction coil heats an additional region of one of the tubes.

Referring to FIGS. 11-14 another embodiment of the invention is shown. In FIG. 11, the temporarily joined together outer tube 110 and inner tube 112, similar to the tubes 10 and 12 of FIG. 2, are heated in an induction heating apparatus including induction coil 136 that heats the overlapped region 128 of the tubes and an additional induction coil 137 that heats an additional region 129 of the tube 112.

Figure 12:
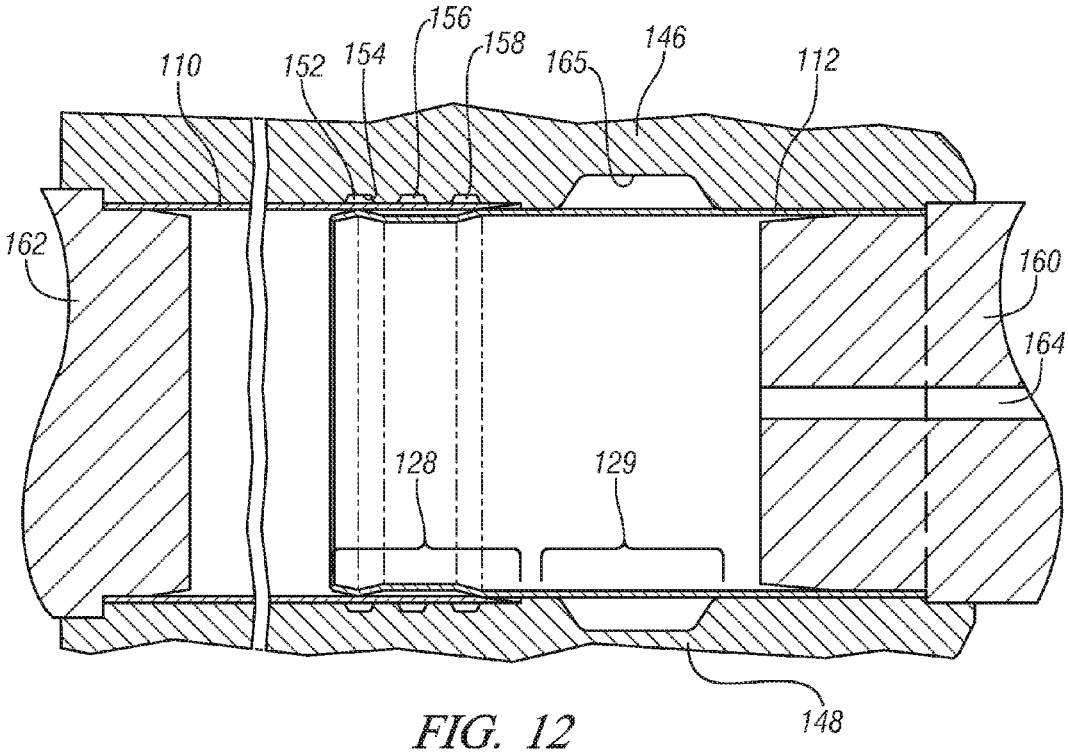
FIG. 12 is a section view showing the tubes of FIG. 11 placed in a pair of dies having a die cavity adjacent the overlapped region of the tubes and an additional die cavity, and seals sealing the end of the tubes.

After the overlapped region 128 and the additional region 129 are heated to soften the metal, the tubes 110 and 112 are captured between dies 146 and 148 as shown in FIG. 12. The dies 146 and 148 have a die cavity 152 including ring-shaped cavity portions 154, 156 and 158 that encircle the overlapped region 128 of the tubes 110 and 112. In addition, the dies 146 and 148 have an additional die cavity 165 that aligns with the additional region 129 of the inner tube 112. A seal unit 160 is engaged in the end of the inner tube 112. Another seal unit 162 is engaged in the end of the outer tube 110.

Figure 13:
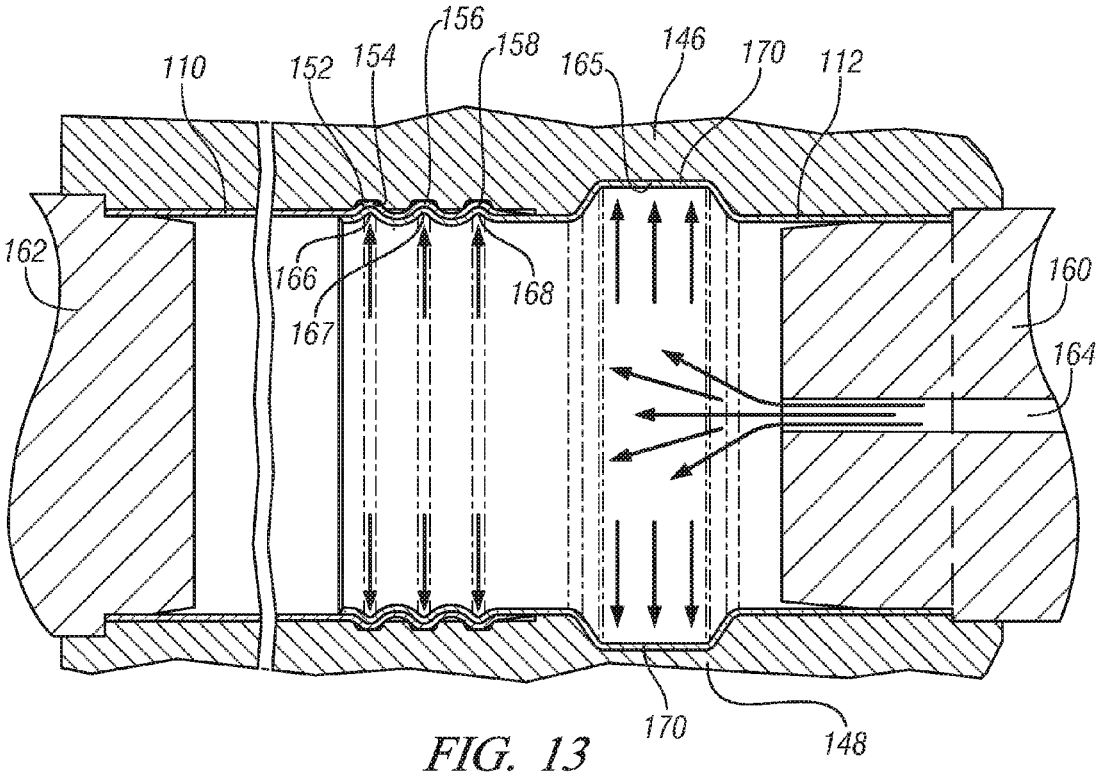
FIG. 13 is a section view showing pressurized gas or steam expanding the tubes outwardly into the die cavities; and, FIG. 14 is a section view showing the tubes permanently joined together.
Figure 14:
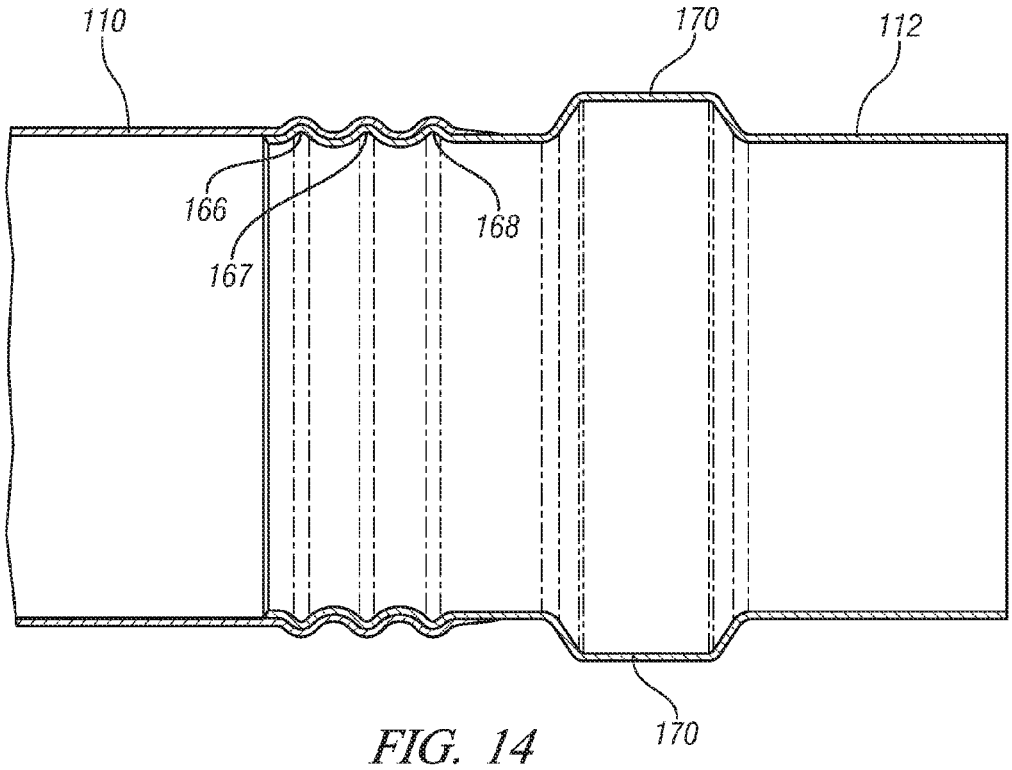

Referring to FIG. 13, pressurized gas or steam is introduced through an inlet 164 provided in the seal unit 160 and expands the heated overlapped portion 128 of the tubes 110 and 112 radially outwardly into the cavity portions 154, 156, and 158 of the die cavity 152 so that the tubes 110 and 112 are thereby permanently joined together by interlocking engagement of the walls via the formation of annular corrugations 166, 167 and 168. Simultaneously, the pressurized gas or steam expands the tube 112 outwardly into the die cavity 165 to form a bulged wall section 170 of the inner tube 112. Thus, it is seen that the tubes are simultaneously attached together and also the inner tube 112 is formed to a desired shape and cross section in the same set of dies. Thereafter, the dies are opened and the permanently joined-together tubes, shown in FIG. 14, are removed and cooled to ambient temperature.

The foregoing description of the invention is merely exemplary in nature and, thus, variations thereof are intended to be within the scope of the invention. For example, although the embodiment of FIGS. 11-14 provides an additional cavity 160 in the dies for forming bulged wall 170 in the inner tube 112, it will be understood that such additional cavities may be provided for simultaneously forming the walls one or both of the inner and outer tubes at the same time that the tubes are permanently joined together by the formation of interlocking structures. Furthermore, the permanent joining together of the inner and outer tubes is not limited to the formation of annular interlocking corrugations. Any configuration of expanded interlocking structures, such as spirals or splines or dimples may be formed by providing correspondingly shaped cavities in the dies 46 and 48. In addition, the heating of the tubes is not limited to the use of induction heating coils, but rather the tubes may be heated in an oven or other heating device. The dies 46 and 48 by any known technique for heating dies, such as providing electric heaters in the dies or providing passages in the dies for carrying hot fluid or gas.

What is claimed is:

1. A method for joining tubes comprising:

providing an outer tube;

providing an inner tube to fit within the outer tube;

forming a ridge on an outer surface of an end of the inner tube;

after forming the ridge, fitting the end of the inner tube into an end of the outer tube to form an overlapped region of tube wall in which the outer tube overlies the ridge of the inner tube, and an additional region of at least one of the tubes that is not overlapped;

after fitting the end of the inner tube into the end of the outer tube, roll forming the outer tube about the ridge of the inner tube to create a pressure tight joint between the overlapped region of the tubes;

after roll forming to create a pressure tight joint, heating the overlapped region of the tubes and also heating the additional region of the at least one of the tubes;

after heating the tubes, placing the heated overlapped region and the heated additional region of the at least one of the tubes in a pair of dies, the dies having a plurality of ring shaped cavities that encircle the overlapped region of the tubes and an additional die cavity adjacent the additional region of the at least one of the tubes; and, after placing the tubes in a pair of dies, introducing pressure into the tubes to expand the overlapped region of the tubes outwardly into the plurality of ring shaped cavities that encircle the overlapped region of the tubes and thereby form an interlocking joint by forming a plurality of annular corrugations between the outer tube and the inner tube at the overlapped region and also expanding the additional region of the at least one tube outwardly to form a bulged wall section whereby the interlocking joint is free of the formed ridge.

2. The method of claim 1 further comprising the pressure being introduced by installing seals in the ends of the outer tube and the inner tube and introducing steam through at least one of the seals.

3. The method of claim 1 further comprising the pressure being introduced by installing seals in the ends of the outer tube and the inner tube and introducing hot gas through at least one of the seals.

4. The method of claim 1 further comprising said dies being heated prior to placing the heated tubes into the dies.

5. The method of claim 1 further comprising said overlapping regions of the tubes being heated by placing the tubes in an induction heating coil and conducting electric current to the induction heating coil.

* * * * *